United States Patent [19]

Kawanishi et al.

[11] 4,265,993

[45] May 5, 1981

[54] MAGNETIC TONER FOR ELECTROSTATIC IMAGES AND TRANSFER COPYING

[75] Inventors: Tsuneaki Kawanishi; Akio Mukoh; Hirosada Morishita, all of Hitachi, Japan

[73] Assignee: Hitachi Metals, Ltd., Tokyo, Japan

[21] Appl. No.: 52,442

[22] Filed: Jun. 26, 1979

[30] Foreign Application Priority Data

Jun. 28, 1978 [JP] Japan ..... 53-77445

[51] Int. Cl.[3] ..... G03G 9/14

[52] U.S. Cl. ..... 430/107; 430/109; 430/903; 430/904; 428/407

[58] Field of Search ..... 430/107, 109, 903, 904, 430/122; 428/407

[56] References Cited

U.S. PATENT DOCUMENTS

| | | | |
|---|---|---|---|
| 2,846,333 | 8/1958 | Wilson | 430/108 |
| 3,377,286 | 3/1968 | Stricklin | 430/109 |
| 3,639,245 | 2/1972 | Nelson | 430/109 |
| 3,925,219 | 12/1975 | Strong | 430/107 |

*Primary Examiner*—John D. Welsh

*Attorney, Agent, or Firm*—Finnegan, Henderson, Farabow, Garrett & Dunner

[57] ABSTRACT

Magnetic toner employable as a developer for electrophotographic duplication system consisting of the steps of developing electrostatic latent image on a carrier, overlaying a copying sheet on said carrier of developed image, and transferring the developed image to said sheet, characterized by containing magnetic fine particles of a electric resistivity from $10^9 \sim 10^{16}\Omega\cdot$cm (at 4000 V/cm DC) and dielectric constant from 2.6~5.

5 Claims, 1 Drawing Figure

MAGNETIC TONER FOR ELECTROSTATIC IMAGES AND TRANSFER COPYING

FIELD OF THE INVENTION

The present invention relates to a development material for wide use in the electrophotographic apparatus, electrostatic recording technique etc., and more particularly to a magnetic toner of the single component type for use, say, in the magnetic brush development process. The present invention relates particularly to transferable magnetic toners.

BACKGROUND OF THE INVENTION

Conventionally in electrostatic photography, an electrostatic latent image has been formed on a photoconductive plate such as selenium, zinc oxide or the like, which has been electrostatically developed by adding developer particles comprising carrier particles such as glass beads, iron powder or the like and colored micropowder of insulating toner charged by friction, contacting with carrier particles.

Such developed image has been directly recorded or transferred by piling a transference sheet thereon and applying an electric field.

The images transferred on sheets have been fixed, for example, by pressure or heat.

On the other hand, in order to simplify and miniaturize electronic copying apparatus, magnetic toners employing no carrier have been developed. There has been proposed a process in which toners contain magnetic powder, such as magnetite ($Fe_3O_4$), provided with high electroconductivity and the development is carried out by inducing the reverse charge to the electrostatic image (U.S. Pat. No. 3,639,245). There have been found magnetic toners usable for such developing system (U.S. Pat. No. 3,925,219). Such electroconductive magnetic toners are mainly used for the direct recording on the photosensitive body, frequently on the photosensitive paper containing zinc oxide. By the use of such toners and recording system, highly distinct copies can be provided by means of a copying apparatus having a simple structure. The copying system which has been conventionally desired is not of a system recording directly on photosensitive paper but of a system recording on normal recording paper or plain paper, i.e., a system in which toner particles adhering on a photosensitive body by the development process are transferred to a transferring sheet by piling the toner particles on the photosensitive body onto the transferring sheet and applying electric field. By such a system, ordinary paper can be usable as the transferring sheet and thus has an advantage that copies can be obtained without employing expensive photosensitive paper.

For such a transferring system, there have been conventionally used binary developer powder in which carriers and toners are mixed together. If the above-mentioned magnetic toners are employed, copying apparatus can be simplified and miniaturized. Additionally substantial merit can be expected because there is no requirement for controlling the mixing ratio of the carrier and toner, the absence of deterioration of the developing agent due to deterioration of the carrier, and the absence of liberation of carrier waste. For such reasons, there has been proposed an indirect recording system, in which the developed image has been fixed on a transferring sheet by employing such electrically conductive magnetic toners (Japan Laid Opened Patent Application No. 26044/1976). However, as toners are electrically conductive, the transferrence of the toners cannot be carried out well, even if we modify the transferring system. It was difficult to provide copies usable in practical use.

Hence, there have been proposed developing and transferring systems in which the electro-conducivity of magnetic toners is reduced to a value of less than $10^{-6}$ $\mho \cdot cm^{-1}$ to provide insulating toners such as conventional non-magnetic toners and the inner polarization in the toners by electric field is utilized (Japan Laid Opened Patent Application No. 90336/1975, 92137/1975 and 133026/1976). In addition, there have been proposed, in the use of insulating magnetic toners, a transferring process in which charge of the same polarity as, or inverse polarity to, the electrostatic image is applied on the toner on the photosensitive body and the image is transferred by charge of the same polarity as, or inverse polarity to, the electrostatic image (Japan Laid Opened Patent Application No. 102644/1976), and such a process in which the image is transferred to transferring sheet which has been charged (Japan Laid Opened Patent Application No. 72436/1976). In addition, there have been proposed various toners comprising a thermoplastic resin and magnetic fine particles and having a electro-conductivity of less than $10^{-3}$ $\mho \cdot cm^{-1}$ provided with a fluidity improver (Japan Laid Opened Patent Application No. 101535/1976, 126836/1976 and 133028/1976).

The inventors have found that there arise various problems frequently when images are developed by conventionally known developing processes and transferred from the photosensitive body by employing conventionally known toners and that such problems result from the toners being used so that care should be taken in the electric characteristics such as electric conductivity, dielectric constant, etc. of toners, and particle size of toners.

It is important to take particular consideration of resin composition of toners corresponding to the fixing procedure of the toners to the transferring sheet.

Using conventional toners which have not taken into account such conditions may cause lack of uniformity of a developed image, poor transferring efficiency, or fogging, or tendencies to cause fogging, irregular transferring, and surface roughness of image when toners of high transferring efficiency are used. Hence such toners cannot be considered to be practical.

SUMMARY OF THE INVENTION

In view of the above-mentioned situation, it is a primary object of this invention to provide magnetic toner compositions having favorable characteristics in both steps of the development and transference by controlling not only the electric resistivity but also the dielectric constant, particle size, etc. of the magnetic toner compositions within suitable ranges. Namely, this invention provides magnetic toner compositions capable to transfer toner images having electric resistivity from $10^9$ to $10^{16}$ Ohm·cm at 4000 V/cm and a dielectric constant ($\epsilon_S$) from 2.6 to 5 which can transfer well-defined images which have not obtained by conventional magnetic toner compositions.

It is another object of this invention to provide magnetic toner compositions comprising a number of particularly favorable resin compositions depending on the fixing procedure of toners to transferring sheet.

Fixing procedures of toner compositions inlcude thermal fixing and pressurization.

In order to impart thermal fixing activity to toner compositions, various types of thermoplastic resins may be usable but should be selected properly depending on the thermally fixing procedures, such as heating in an oven, heating by means of hot rolls, etc.. Particularly effective and advantageous thermoplastic resins include epoxy resin, acrylate/styrene resin, polyester resin and phenol resin. Such resins are chosen properly depending on the thermal fixing conditions, such as thermal fixing temperature, fixing time, pressure of hot rolls, etc. in view of the softening point, melt viscosity, etc.

In a system employing hot rolls, acrylate/styrene resin and polyester resin are effective. In a system employing heating in an oven, resins having a softening point from 90° to 130° C. are effective. Such resins may be used as such or in combination with other compatible resins. Such resins should have a glass transition point of higher than 40° C. because of the close relation of the glass transition point of the selected resin with the storage stability, fluidity, etc. of the toner compositions, If a resin having a glass transition point of less than 40° C. is used, the toner composition tends to be agglomerated and to make the favorable transference difficult.

When it is intended primarily to fix thermally by means of hot rolls, a thermoplastic styrene/acrylate copolymer is used. Such styrene/acrylate copolymers include various types depending on the monomer compositions. As a result of vast study on various types of styrene/acrylate copolymer as a resin for fixing magnetic toner compositions by hot roll procedure, it has been found that the most suitable resin for magnetic toner compositions comprises (1) at least one monomer selected from the group comprising acrylic and methacrylic acid, (2) styrene and (3) at least one monomer selected from alkyl acrylates in which the alkyl moiety contains from 1 to 12 carbon atoms and alkyl methacrylates in which the alkyl moiety contains from 2 to 12 carbon atoms. The highly effective transference of toner compositions is made possible without irregular development by using a resin having such a composition to provide transferred images of magnetic toner composition which can be put into practical use.

In order to impart fixing ability by pressurization to a toner composition, a resin for fixing by pressurization may be employed. Highly pressure-fixing resins include waxy compounds having a distinct compression yield point. Such a compression yield point is measured by the stress-strain characteristic of a fusion-moulded cylinder having a cross-sectional area of 1 $cm^2$ and a height of 1 cm from the sample by means of a compression tester (Model VTM-1 available from Toyo Sokki KK). Effective resins for pressure fixing include waxy compounds having a compression yield point ranging from 3 to 300 kg weight/$cm^2$ as measured by the above-mentioned procedure.

When a way compound has a compression yield point within the above-specified range, it may be blended with various resins for various purposes. Suitable waxy compounds are crystalline compounds having a softening point of higher than 50° C. and include carnauba wax, montan wax, castor wax, paraffin wax, microcrystalline wax, chlorinated paraffin, amide wax, fatty acids or metal salts thereof, polyethylene glycol and ester derivatives thereof, aromatic waxes such as dicyclohexyl phthalate and diphenyl phthalate, etc. Such waxy compounds may be added with a ethylene/vinyl acetate copolymer, rosin and derivatives thereof, polyterpentine, low molecular weight styrene copolymers, aromatic petroleum resins, thermoplastic polyamide resins, etc., in order to improve the pressure-fixing ability. They may also be added effectively with a silicone resin in order to improve the fluidity of toner compositions.

By employing such a resin, the toner compostion can be fixed favorably on recording sheets by means of conventional fixing rolls having a linear pressure from 20 to 30 kg weight/cm.

BRIEF DESCRIPTION OF THE DRAWING

The FIGURE shows a relation between the dielectric constant and transference efficiency of toner compositions.

DESCRIPTION OF THE PREFERRED EMBODIMENTS

Figure 1:
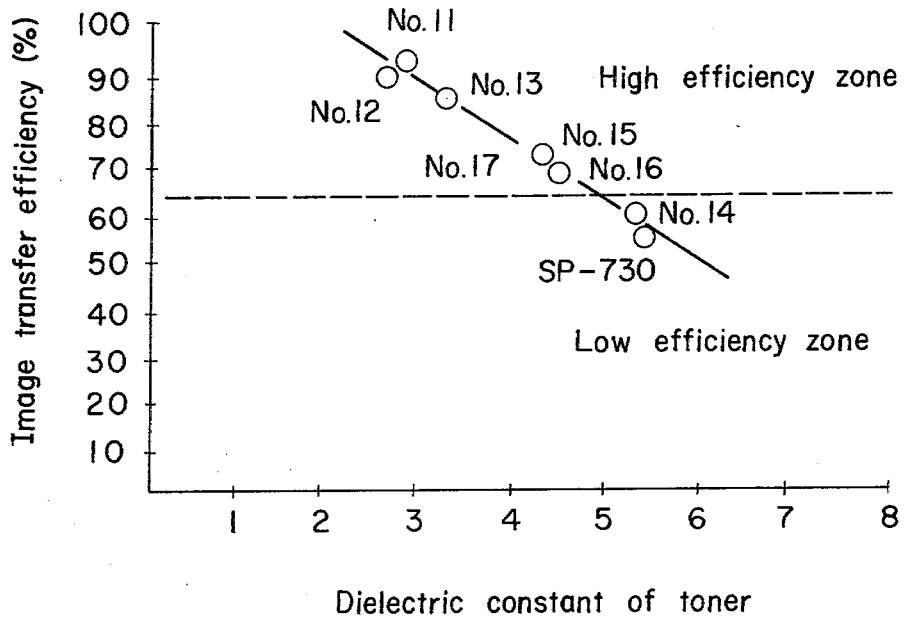

The magnetic toner compositions according to this invention develop favorably conventional photosensitive materials for electrophotography, such as selenium master paper, zinc oxide master paper, organophotoconductive materials, multilayered composites of various photosensitive materials, etc. by being applied to a developing magnetic roll to form a magnetic brush. The toner compositions can transfer favorably onto transferring paper by piling together with the transferring sheet and applying an electric field thereon. In the transference, conventional transferring sheets may be employed. However, transferring sheets having a volume intrinsic resistivity from $10^{11}$ to $10^{15}$ Ohm·cm measured under conditions at 25° C. and relative humidity of 70% are preferred. Transferring sheets having a volume intrinsic resistivity from $10^{13}$ to $10^{15}$ Ohm·cm are more preferable.

The magnetic toner compositions according to this invention are prepared as follows:

Fine powder of a magnetic material, and fixing resin, a color-controlling pigments or dyes are premixed in a mixer such as a ball mill, super mixer or the like and molten and plasticized in a plasticizing machine such as two rolls, kneader, or the like, followed by cooling, pulverizing and classifying. The resulting pulverized magnetic toner composition may be used as such but it is more effective to form spheroids of the toner composition by falling through a heating furnace for improving the fluidity of the toner composition.

As the above-mentioned toner materials, conventional materials for magnetic toner compositions may be usable. Fine magnetic particles include very strongly magnetized materials by a magnetic field to the direction thereof. Examples of such fine magnetic particles include alloys and compounds of ferromagnetic elements such as iron, cobalt, nickel, etc., e.g., ferrite, magnetite, etc. and various alloys, etc. capable of exhibiting ferromagnetism by effecting certain treatment such as heat treatment. Such ferromagnetic materials have preferably an average particle size from about 0.1 to about 3 microns for adding them into toner compositions. Desirable amounts to be added into a toner composition range from 30 to 75% by weight of the total toner composition. If the amount is less than 30% by weight, the magnetic power will be reduced so that the toner will tend to be released from a developing magnetic roll to disturb the image. The amount beyond 75% by weight will make the milling difficult. In addition, since such fine magnetic particles as such have, in general, electroconductivity, the electric resistivity will be unnecessarily reduced.

It is necessary to select properly a fixing resin depending on the fixing procedure employed. As the dielectric constant of a toner composition is affected markedly by electrically insulating resin, the dielectric constant of the latter ranges desirably from 2.6 to 5. However, when the dielectric constant of a toner compsition falls within the range as specified by this invention, there will be no hindrance to using a resin having a dielectric constant as specified above. As a fixing resin in the fixing systems by heating the toner in an oven or by heating through heating rolls, there may be usable such thermoplastic resins as homopolymers and copolymers of a monomer or monomer mixture selected from styrenes, vinyl esters $\alpha$-methylene aliphatic carboxylate esters, acrylonitrile, methacrylonitrile, acrylamide, vinyl ethers, vinyl ketoners, N-vinyl compounds, etc. or mixtures thereof. There may be also usable non-vinylic resins such as non-vinylic thermoplastic resins such as rosin-modified phenol/formalin resin, oil-modified epoxy resin, polyurethane resin, cellulose resin, polyether resin, etc. and mixtures thereof with the above specified vinylic resins.

On the other hand, in the pressure fixing system by means of pressure rolls, there may be usable pressure sensitive resins such as higher aliphatic carboxylic acids and metal salts and derivatives thereof, higher aliphatic carboxylamides, waxes, rosin derivaties, alkyd resin, epoxy-modified phenol resins, natural resin-modified phenol resins, amino resin, silicone resin, polyurethane, urea resins, polyester resins, copolymerized oligomers of acrylic acid or methacrylic acid and a long chain alkyl acrylate or a long chain alkyl methacrylate, ethylene/vinylalkyl ether copolymers, copolymers containing maleic anhydride, petroleum residuum, rubber, etc..

Such resins may be optionally chosen or optionally mixed together, but in order not to reduce the fluidity of toner compositions, a resin or a resin mixture having a glass transition temperature of higher than 40° C. may be usable advantageously. A fixing resin should be added in a toner composition in an amount of higher than 20% by weight of the toner composition except the fine magnetic particles, color-controlling pigments and dyes in order not to reduce the fixing ability of the toner composition.

Color-controlling pigments and dyes may be selected from various ones which have been used conventionally as dry type developers. It is, however, necessary to add such pigments and dyes in a content within the range which doesn't deteriorate electric characteristics of the toner compositions. In this invention, such an amount is suitably less than 10% by weight of the total toner compositions. Usable pigments and dyes include, for example, carbon black, Nigrosine dyes, Aniline Blue, Chalcoil Blue, Chrome Yellow, Mehtylene Blue Chloride, Phthalocyanine Blue, Lamp Black, Rose Bengal, etc..

If the fine magnetic particles are inherently colored to an extent that no such color-controlling agent is required, it may be omitted. On the contrary, an improvement may be achieved in the quality of transferred image by using a selected pigment or dye in combination with the fine magnetic particles and a fixing resin for controlling the frictional charge between the toner composition and the surface of developing magnetic roll or the surface of photosensitive material. A pigment or dye should be added in an amount within the range that the toner composition retains the electrical characteristics as specified in this invention.

As disclosed hereinbefore, toner compositions having such components in such proportions are used by pulverizing and classifying or pulverizing, forming into spherules and classifying. The classification may be carried out by means of a classifier, such as Alupine's zigzig classifier. It is desirable to limit the average particle size within the range from 3 to 30 microns. If there are many particles having a particle size of less than 3 microns, the resulting image will be produced in a high image concentration but markedly fogged. On the other hand if the toner composition contains many particles having a size of larger than 30 microns, the fogging will be avoided but the image concentration will be reduced to tend to roughen the image.

Classified toner particles may be added with conventional toner additives. Such additives are added for controlling the electric resistivity and fluidity of toner compositions. After the addition of such additives, the electrical characteristics of the resultant toner should fall within the specified ranges. Such additives may be various inorganic or organic materials having an average particle size from 0.01 to 500 microns. Preferably, such additives are those which are effective in an amount from 0.04 to 4% by by weight. If such additives are added in an amount less than or more than the above-specified range, the electrical characteristics will fall outside the specified range so that a transference image of high quality will not be produced. Such additives which are compatible with the present invention include, for example, powdery silica such as aerosil, carbon black, various dyes, metal-containing dyes, micropowder of resins such as polytetrafluoroethylene, styrene, etc. Among them, carbon black, if added in an amount from 0.1 to 0.4% by weight of the total compositions, has particularly marked effect for improving the electrical characteristics of the toner and enhancing the development and transference of the toner.

The electrical characteristics of the magnetic toner compositions according to this invention depend on types and proportions of materials and the preparing procedures. The electric resistivity is determined by weighing a suitable amount (10 and several mg) of a magnetic toner composition, charging into an insulating polyacetal cylinder which has been modified from a dial gauge and having a diameter of 3.05 mm (sectional area: 0.073 $cm^2$) and measuring the electric resistivity under a load of 0.1 kg weight in an electric field of 4,000 V/cm, D.C.. The dielectric constant is determined by a procedure employing "Q" meter in which the bottom of a cylindrical cell having an inner diameter of 42 mm is covered with a conductive material to provide an electrode, and the side wall is covered with a polyacetal insulating material having a thickness of 3 mm and a height of 5 mm. The cylindrical cell is charged with 5.0 g of a magnetic toner composition, sandwiched between an opposed pair of disk electrodes of a "Q" meter (available from Yokohama Denki Seisakusho under the trade name of Model QM-102A) and the dielectric constant is measured at a frequency of 100 KHz.

The present invention will be disclosed hereinafter by way of the following examples, however, such examples are not intended to limit the scope of the invention.

EXAMPLE 1

Polyester resin (available from Hitachi Kasei under the trade name of PS #2) having a softening point of 120.5° C. and a glass transition point of 61.2° C. (55 parts by weight), a Nigrosine dye (available from Orient Kagaku under the trade name of Spirit Black SB) (5 parts by weight), magnetite (available from Toda Kogyo under the trade name of KN 320, tri-iron tetroxide) (40 parts by weight) as microfine magnetic particles were weighed and premixed under dry condition for 5 minutes in a Super Mixer. The mixture was then kneaded and plasticized in a cokneader (available from Buss, Switzerland) heated at a temperature from 100° to 110° C. After cooling, the plasticized mixture was crushed and then finely divided by means of a jet mill. The finely divided toner composition was blown into a spheroidizing furnace by means of an air jet nozzle and spheroidized therein by hot air at a temperature from 150° to 170° C. The spheroidized toner composition was classified by means of a zigzag classifier to remove the toner particles having a size of less than 3 microns and of larger than 30 microns. The resulting toner particles were added with 0.2% by weight of powdery silica (available from Nippon Aerosil under the trade name of Aerosil 380) as a fluidity improver to provide sample No. 1 of magnetic toner composition.

Sample No. 2 was prepared similarly by classifying the spheroidized toner prepared similarly by means of the zig-zag classifier to remove the particles having a size of larger than 30 microns. Sample No. 3 was prepared similarly by removing the particles having a size of less than 30 microns. These samples were added similarly with powdery silica as a fluidity improver.

The electrical characteristics of such types of toner composition were determined in accordance with the above-mentioned procedures. Samples Nos. 1, 2 and 3 had electric resistivities of $1\times10^{15}$ Ohm·cm, $9\times10^{14}$ Ohm·cm and $4\times10^{15}$ Ohm·cm, respectively as determined at 4,000 V/cm, D.C.. The samples had dielectric constants of 2.79, 2.82 and 2.75, respectively.

Said 3 types of toner composition were charged into a duplicator which was a duplicator for transferring magnetic toner compositions using zinc oxide master paper (available from Sharp under the trade name of SF-730) for the preparation of transferred images with the toner. Transferred images of high image density were prepared, but fogging of images was observed markedly for Sample No. 2 and images by Sample No. 3, no fogging was observed but was roughened, thus toners of Sample Nos. 2 and 3 provided no images which can put into practical use. On the other hand, the toner of Sample No. 1 provide transferred images of very high quality. When the transferred image is thermally fixed in an oven to provide fixed images of very high quality.

COMPARATIVE EXAMPLE 1

A magnetic toner composition containing 23% by weight of fine magnetic particles was prepared similarly to Sample No. 1 in Example 1. The toner composition has electric resistivity of $6\times10^{15}$ Ohm·cm and a dielectric constant of 1.95. Upon the evaluation similar to Example 1, sufficient image density could not achieved and the toner particles were scattered over the images. It was found that the toner particles were not retained satisfactorily on the developing magnetic roll to be scattered over the photosensitive paper from the roll and thus scattered particles fouled the images. On the other hand, a magnetic toner composition containing 77% by weight of the fine magnetic particles was prepared similarly to Sample No. 1 in Example 1. The composition could not plasticized sufficiently in the kneader even by increasing the kneading temperature not to prepare a toner composition.

EXAMPLE 2

A spheroidized magnetic toner composition was prepared from 16 parts by weight of an epoxy resin having a melting point from 75° to 85° C. (available from Shell Chemicals under the trade name of Epikote #1002), 24 parts by weight of an epoxy resin having a melting point from 95° to 105° C. (available from Shell Chemicals under the trade name of Epikote #1004), 5 parts by weight of carbon black (available from Mitsubishi Kasei under the trade name of Carbon Black #44), 55 parts by weight of microfine magnetic particles (available from Toda Kogyo under the trade name of KN-320) in a similar manner to Example 1. The prepared spheroidized toner particles were classified so as to obtain particles having an average particle size ranging from 3 to 30 microns. Sample No. 4 comprised such classified particles as such. Sample No. 5 was prepared by adding 0.1% by weight of carbon black (#44) into the spheroidized toner particles and Sample No. 6 was prepared by adding 0.2% by weight of carbon black (#44) into the spheroidized toner particles.

Sample Nos. 4 through 6 exhibited electric resistivities of $6\times10^{15}$, $4\times10^{14}$ and $3\times10^{14}$ Ohm·cm respectively and dielectric constants of 3.96, 4.27 and 4.09, respectively.

These toner particles were stuck on a developing magnetic roll of a duplicator for binary developing system using selenium photosensitive material (available from Copia under the trade name of Selex 500) to evaluate the toner image. Toner Sample No. 4 tended to be agglomerated on the developing magnetic roll. On the other hand, the toner of Sample Nos. 5 and 6 had improved fluidity due to the carbon black added thereto and electrical characteristics falling within the specified ranges in this invention to provide transferred images with high qualities.

EXAMPLE 3

In a stainless steel vessel, 21 parts by weight of wax having a softening point of 128° C. and a glass transition point of 56.5° C. (available from Mitsui Sekiyu Kagaku under the trade name of Hiwax 200P), 7 parts by weight of a ethylene/vinyl acetate copolymer (available from Allied Chemicals under the trade name of ACP 400), 70 parts by weight of finely divided magnetic particles (available from Toda Kogyo under the trade name of KN-320) were plasticized at 150° C. Spheroidized toner particles were prepared from the cooled plasticized composition in a similar manner to Example 1. Sample No. 7 comprised the spheroidized particles exclusively. Sample No. 8 was prepared by adding 0.1% by weight of carbon black (#44 prepared by Mitsubishi Kasei), Sample No. 9 by adding 0.2% by weight of the carbon black, Sample No. 10 by adding 0.4% by weight of the carbon black.

Sample Nos. 7 through 10 had electric resistivities of $1\times10^{8}$, $3\times10^{11}$, $3\times10^{10}$ and $1\times10^{10}$ ohm·cm respectively and dielectric constants of 6.65, 3.28, 3.84 and 4.24, respectively. There toner particles were stuck on a developing magnetic roll of a duplicator for binary developer system using selenium photosensitive paper (available from Xerox under the trade name of Xerox 2200) to evaluate the toner images. Toner of Sample No. 7 exhibited marked agglomeration of the toner on the developing magnetic roll so that no developed images nor transferred images could be obtained. Since the electrical characteristics and fluidity of the toners were improved by the addition of carbon black, toners of Sample Nos. 8 through 10 produced transferred images of high qualities. When the transferred images were fixed by means of pressure rolls under a linear pressure of 30 kg/cm, the images were fixed favorably.

EXAMPLE 4

Toner compositions were prepared from 55 parts by weight of a fixing resin selected from the group comprising polyester resin (available from Hitachi Kasei under the trade name of PS 2), acrylate/styrene resin (available from Bayer, West Germany under the trade name of Crelane A-101), epoxy resin (mixed resins comprising 3 parts by weight of Epikote #1004 and 1 part by weight of Epikote #1001, both available from Shell Chemicals), a mixture comprising 7 parts by weight of wax (available from Mitsui Sekiyu Kagaku under the trade name of Hiwax 200 P) and 3 parts by weight of ethylene/vinyl acetate copolymer (available from Allied Chemicals, U.S.A. under the trade name of ACP 400) and a mixture comprising 10 parts by weight of Hiwax 200 P and 1 part by weight of polyamide resin (Persamide 911), 40 parts by weight of finely divided magnetic particle (available from Toda Kogyo under the trade name of KN-320), and 5 parts by weight of carbon black (available from Mitsubishi Kasei under the trade name of Carbon Black #44) and called as Sample Nos. 11, 12, 13, 14, 15 and 16, respectively in the order of resin used. Sample Nos. 11 through 13 were spheroidized in a similar manner to Example 1 and Sample Nos. 14 through 16 were spheroidized in a similar manner to Example 3. In addition, Sample No. 17 was prepared using polyester resin (PS 2) in a similar manner to Example 1 except that hot rolls were employed as a kneader and spheroidized similarly. Sample No. 11 through No. 13 had electric resistivities of $1\times10^{15}$, $4\times10^{11}$, $3\times10^{15}$ Ohm·cm, respectively and dielectric constants of 2.79, 2.70 and 3.11, respectively. Sample Nos. 14 through 16 had electric resistivities of $1\times10^{9}$, $3\times10^{11}$ and $1\times10^{9}$ Ohm·cm and dielectric constants of 5.22, 4.00 and 4.46, respectively, whereas Sample No. 17 had electric resistivity of $2\times10^{15}$ Ohm·cm and a dielectric constant of 4.34. As a comparative sample, PPC magnetic toner SF-730 of pressure-fixing type for a duplicator of Sharp SF-730 had electric resistivity of $7.1\times10^{7}$ Ohm·cm and a dielectric constant of 5.42.

The transference efficiencies of these toners were studied by charging them to a duplicator Model PT-510 (available from Rikoh) to develop on zinc oxide paper of Type PT-500. The developed zinc oxide paper of PT-500 was piled with transferring paper for duplicator of SF-730 (available from Sharp) and the toner images were transferred under a corona voltage of 8.5 KV, D.C.. The transference efficiencies were determined by measuring the densities of solid black portions on the zinc oxide paper and transferring paper by means of a reflection densitometer and calculating from the following formula:

$$\text{Transference Efficiency, } \% = D_P/(D_M+D_P)\times100$$

wherein $D_m$ represents difference between the densities at the solid black portions and the substrate of zinc oxide paper after the transference step and $D_P$ represents difference between the density at the solid black portions and remaining density on the substrate of transferred image. Sample Nos. 11 through 17 had SF-730 had transference efficiency of 91, 90, 83, 60, 74, 67 and 56%. FIG. 1 shows relation between such transference efficiency and the dielectric constants.

It has been found that the transference efficiency is increased with the decreased dielectric constant and vice versa. It can be seen that in order to achieve a transference efficiency of higher than 65%, the dielectric constant of the toner should be less than 5. In addition, it has been confirmed that toner compositions having a dielectric constant of less than 2.6 have often electric resistivity of higher than $10^{16}$ Ohm·cm so that they could not be put into practical use due to marked decrease in the developing ability. As disclosed hereinbefore, the present invention intends to limit electrical characteristics of toner compositions which are required for the compatibility of developing and transferring abilities of the magnetic toner compositions. When a magnetic toner having electrical characteristic falling within the specified ranges is used, transferred images of high quality can be produced irrespective of the type of photosensitive material to be developed.

Furthermore, examples for thermosetting toner will be described in detail:

EXAMPLE 5

Forty parts by weight of PS#2 (make of Hitachi Chem. Co., Ltd.) or a polyester resin of glass transition point at 61.2° C., softing point at 120.5° C. and 60 parts by weight of magnetic $Fe_3O_4$ (EPT-500, make of Toda Ind. Co., Ltd.) as magnetic particles are mixed by dry system 5 minutes preparatorily. Then the mixture is fused and kneaded at 100°~110° C. in a kneader (make of Buss A.S. in Switzerland), and is crushed after cooling, then pulverized in a jet mill. The pulverized toner is blown through an airjet nozzle into a spheroformer furnace to effect a spheroforming heat-treatment with the airstream of 150°~170° C. The obtained spherical toner particles are separated from those smaller than 5μ and larger than 25μ through a zigzag classifier. This spheroform toner is mixed with 0.2% by weight of carbon black #44 (make of Mitsubishi Chem. Co., Ltd.)

The prepared toner is shaken sufficiently to let its particles attached with carbon-black. The electric characteristics of the toner was determined. The electric resistivity was $5\times10^{15}$ Ω·cm, while the dielectric constant was 3.55. This toner is placed in a duplicator SF-730 (make of Sharp Corp.; magnetic toner-electric field type for recording with Zn O-master paper) to prepare the duplicated toner-image. Excellent picture copies are obtained. Since the employed duplicator was of pressure-fixing type, the image is successfully thermoset after being heated 10 minutes with Hitachi Hotplate EH-101.

EXAMPLE 6

The toner of Example 5 is attached to the magnetic developing-roll of a duplicator Selex 500 of thermosetting type (make of Copyer Co., Ltd; image-transferring electric field type for the developer of two-component system and employing selenium photoelectric tube) to evaluate the resulted toner-image. Excellent picture copies are obtained.

EXAMPLE 7

Krelan A-101 (make of BASF, West Germany) or an acrylstyrol resin of glass transition point at 59.0°, softening point at 119° C. is employed to repeat the process of Example 5. The resulted toner has a electric resitivity of $10^{14}$ Ω·cm and a dielectric constant of 3.70. When this toner is tested according to the processes of Examples 5 and 6, excellent picture copies are obtained.

EXAMPLE 8

The process of Example 5 is repeated except for employing phenol resin PR-317 (make of Sumitomo Durez Co., Ltd.) or a Phenol Novolac resin of glass transition point at 48° C., softening point at 90° C. The prepared toner has a electric resistivity of $7\times10^{14}$Ω·cm and a dielectric constant of 4.00. When this toner is tested according to the processes of Examples 5 and 6, excellent picture copies are obtained.

REFERENTIAL EXAMPLE 2

When the processes of Examples 5, 7 and 8 are repeated but omitting the step of spheroforming heat treatment of toner, it is resulted that the electric characteristics have been intact while the toner on the developing magnetic roll is apt to be coagulated by the revolution of magnetic roll so that fine copies of picture are not obtained.

EXAMPLE 9

Epicote 1001 and Epicote 1004 (epoxy resins, make of Shell Sekiyu K.K.) are mixed at a rate of 1:3 to prepare a magnetic toner according to the process of Example 5. The mixed resin of Epicotes 1001 and 1004 has a glass transition point of 59.0° C. and a softening point of 88.0° C. In the present example, the cases of mixing the spheroformed toner without carbon black and with 0.1%, 0.2%, 0.4% by weight of carbon black respectively are compared under respective Test Nos. 21, 22, 23 and 24. The obtained results are shown in Table 1. It is noted that respective toners fall within the scope of the present invention.

TABLE 1

| Toner No. | Electric Characteristics of Magnetic Toners: Dielectric constant | Electric resistivity (Ω . cm) |
|---|---|---|
| 21 | 3.95 | $5\times10^{14}$ |
| 22 | 4.10 | $7\times10^{13}$ |
| 23 | 4.25 | $5\times10^{13}$ |
| 24 | 4.27 | $10^{13}$ |

When these toners were evaluated in the fineness of picture images by a duplicator similarly to Examples 5 and 6, it was proved that Toner Nos. 22, 23 and 24 provide excellent copies because of poor fluidity of toner without carbon black.

REFERENTIAL EXAMPLE 3

The mixed epoxy resin of Example 9 is mixed with 40% or 75% by weight of magnetic fine particles to prepare toners. The toner, subjected to spheroforming treatment, is mixed with 0.1% by weight of carbon black to enhance fluidity. In regard to electric characteristics, the electric resistivity and dielectric constant present $5\times10^{15}$Ω·cm and 3.11, respectively, in the case of employing 40% by weight of magnetic fine particles, $8\times10^{12}$Ω·cm and 4.51, respectively, in the case of employing 75% of magnetic particles. These values of characteristics exclude the toners of this Example out of the scope of the present invention. When the picture copies by using these toners are evaluated according to the evaluation process of Examples 5 and 6, the picture images by the toner containing 40% of magnetic particles are not sharp and the image resolution is low, while the picture image by the toner containing 75% of magnetic particles are very sharp but the image density is insufficient. Thus both the toners of the present example proved themselves unacceptable.

EXAMPLE 10

The mixed epoxy resin of Example 9 is mixed with 70% by weight of magnetic toner to prepare a toner. The toner subjected to spheroforming treatment is mixed with 0.1% by weight of carbon black to modify fluidity and electrocharacteristics. Thus resulting electric resistivity and dielectric constant are $10^{14}$Ω·cm and 4.15, respectively, which satisfy the requirements of the present invention. When the obtained toner is tested similarly to Examples 5 and 6, very sharp picture copies are provided, which certainly are superior to those obtained with conventional developers of two-component system.

Furthermore, the magnetic toner of hot-roll fixed type will be described in detail.

As the resin, thermoplastic styrene/acrylic copolymers are employed. Such styrene/acrylic copolymers include various copolymers depending on the monomer compositions. As a result of vast study on various styrene/acrylic copolymer as resin for fixing magnetic toners for electrostatic transference, the inventors have found that the optimum resins for magnetic toners comprise (1) monomer units comprising acrylic acid and methacrylic acid, (2) monomer units comprising styrene and methyl methacrylate and (3) monomer units comprising an alkyl acrylate having 1 to 12 carbon atoms in the alkyl moiety and an alkyl methacrylate having 2 to 12 carbon atoms in the alkyl moiety and contain at least one monomer for each monomer units. That is to say, by using the resins having the above compositions, the toner transference free from irregular development and with high efficiency can be possible to obtain transferred magnetic toner images for practical use.

If any units are absent in said monomer unit, the resulting toners are affected adversely. The inventors have effects of said monomer units (1) through (3) on the toners by evaluating the image characteristics, i.e., image density and image fidelity and the abrasion resistance of toners against the photosensitive bodies. Table 2 lists such results.

TABLE 2

| Characteristics of Toner | Evaluation of Magnetic Toners using Resins Comprising Monomer Units (1) through (3): Composition of Resin (2) | (2) | (2)+(3) | (1)+(2) | (1)+(3) | (1)+(2)+(3) |
|---|---|---|---|---|---|---|
| Image density | x | o | o | x | o | o |
| Image fedelity | x | x | Δ | x | x | o |
| Abrasion resistance | x | x | x | Δ | x | o |

As shown in Table 2, the only resins containing all of the monomer units (1) through (3) show both high image characteristics and abrasion resistance.

The combination and molar ratios selected from each monomer units are selected so that the resulting polymers have glass transition temperature Tg of higher than 50° C., preferably of higher than 65° C. It is necessary that the glass transition temperature is higher than 50° C. and preferably higher than 65° C. in order to improve the fluidity and abrasion and wear resistance of the toners. The glass transition temperature is represented in this invention by values as measured by means of Thermomechanical Analyzer Model TMS-1 available from Perkin Elmer Co.

The glass transition temperature of a resin may be calculated from Tg°K. of homopolymer of each monomer so that the Tg'°K. of a copolymer may be predicted:

$$\frac{1}{Tg'} = \sum_i \frac{Mi}{(Tg)_i}$$

wherein Mi is a molar ratio of monomer i, $(Tg)_i$ is the glass transition temperature in °K. of homopolymer of i monomer and Tg' is the glass transition temperature in °K. of the copolymer.

For this purpose, the combination and molar ratios of monomers selected from monomer units (1) through (3) in this invention are selected so that the Tg value of the copolymer is higher than 50° and preferably higher than 65° in the terms of °C.

Even under the consideration of said glass transition temperature, various combinations of such monomers may be held. However, when resins are synthesized in practice and evaluated by using them in toners, it has been found that the content of monomer units (1) ranges suitably from 5 to 20 molar %, that of monomer units (2) ranges suitably from 20 to 60 molar % and that of monomer units (3) ranges from 20 to 75 molar %. If the content of monomer units (1) is reduced to a value of less than 5 molar % or increased to a value of higher than 20 molar %, the image characteristics of toner, particularly the image density, will be reduced and the printing resistance of the toner against the photosensitive body will also be found to be reduced. If the content of monomer units (2) is less than 20 molar %, the fluidity, printing resistance and wear resistance of the toners will be reduced due to a reduction in the Tg value of the resins. If the content of monomer units (2) exceeds a value of 60 molar %, it is the found that the image characteristics, particularly the image density of the toners, are reduced and the image fidelity is also reduced. If the content of monomer units (3) is reduced to a value of less than 20 molar %, it has been found that the image characteristics, particularly the image density, are deteriorated. If the content exceeds a value of 75 molar %, the fluidity, printing resistance and wear resistance have been found to be deteriorated.

Monomer units (1) and (2) are called as hard monomer components which tend to enhance the glass transition temperature of the resulting copolymers. On the other hand, monomer unit (3) are generally called as soft monomer components which tend to reduce the Tg value of the homopolymers with the increased carbon atoms, thus to reduce the glass transition temperature of the resulting copolymers comprising monomer units (1), (2) and (3).

In order to improve the thermal fixing of toners, it is necessary to control the softening point Ts.p. (°C.) and molecular weight distribution of the resins, i.e., the ratio of the weight average molecular weight $\overline{M}w$ to the number average molecular weight $\overline{M}n$.

When the toners are thermally fixed, the fixing temperature ranges from 150° to 200° C. in conventional copying apparatus. Hence, the thermal fixing is better if the softening point of the fixing resins are lower than said fixing temperature. The softening point of a resin may be determined according to Ball and Ring Method as specified in JIS K-2531.

The softening point of a resin depends on its molecular weight, which, in turn, depends on the polymerization conditions for synthesizing the resin. In the case of styrene/acrylic copolymers, solution polymerization is frequently employed, whose polymerization conditions such as the type and amount of the solvent, catalyst and chain transferring agent, reaction temperature, reaction time, etc. can control the molecular weight of the resulting copolymer. The polymerization conditions are determined so that the softening point of the resulting copolymer is less than the fixing temperature by studying the polymerization conditions to control the molecular weight of the copolymer.

On the other hand, it is necessary to prevent offsetting in the fixing by hot rolls. For this it has been known to have to increase the molecular weight of the resin (Published Japanese Patent Application No. 134652/1975). However, in styrene/acrylic copolymer resins prepared by conventional polymerization process, the molecular weight distribution in the terms of the weight average molecular weight $\overline{M}w$/number average molecular weight $\overline{M}n$ as measured by gel permeation chromatography is often higher than 4.0 to enable to prevent the offsetting. However, as the molecular weight distribution may be reduced depending on the type and amounts of monomers to be used and polymerization conditions, the polymerization conditions should be studied so as to increase the molecular weight distribution.

As stated hereinbefore, it is necessary to select the composition of monomers in the resin and to control the molecular weight and its distribution for improving the image characteristics, fluidity, printing resistance, wear resistance, and thermal fixing of the toners.

The resins according to the invention may be used solely to prepare magnetic toners having good characteristics. However, they may be blended with other resins in order to improve the mechanical and/or temperature characteristics for extending the life of the toners and to improve the fluidity and fixing. Resins to be blended to the resins of the invention include styrene resins, polyvinyl butyral, terpene resins, rosin resins, petroleum resins, epoxy resin, polyamides, wax, ethylene/vinyl acetate copolymer, etc. The ratio of such a resin to be blended depends on the type of the resin but it is important not to exceed a value of 20% by weight as the resin to be blended for preventing deterioration in the developing and transferring characteristics of the toners.

Example for Preparing the Resins:

The following example illustrates a representative resin of this invention;

Into a 3-liter separable flask, 750 g (10.4 moles) of methyl ethyl ketone was charged. After the replacement of the vapor space with nitrogen gas, the flask was heated to 80° C. Separately, 580 g (5.58 moles) of styrene, 725 g (5.11 moles) of n-butylmethacrylate, 145 g (2.01 moles) of acrylic acid, i.e., 44.0 mole % of styrene, 40.2 mole % of n-butyl methyl methacrylate and 15.8 mole % of acrylic acid were mixed together and added with 20 g of azobisisobutyronitrile as a polymerization catalyst and mixed thoroughly. 1470 g of the mixture of the monomers and catalyst was added dropwise into the methyl ethyl ketone heated at 80° C. over about 2 hours. The methyl ethyl ketone was kept at 80° C. from the initiation to the completion of the addition and stirred continuously to carry out the polymerization smoothly. The reaction mixture was continued to be stirred for further 1 hour after the completion of the addition of the monomers and then an additional amount of the catalyst was added dropwise. Namely, 3.0 g of azobisisobutyronitrile was dissolved in 40 g of methyl ethyl ketone (1.8 moles) and added dropwise over 15 minutes. After the dropwise addition, the reaction mixture was stirred for further 1 hour and then added dropwise with a secondary additional catalyst in the same amount as in the first addition over about 15 minutes. After the completion of the secondary dropwise addition, the reaction mixture was stirred for further 1 hour and then added dropwise with a tertiary additional catalyst in the same amount as in the first and secondary additions. The reaction system was maintained at that temperature for 3 hours while stirring and then cooled to ambient temperature to complete the polymerization.

The methyl ethyl ketone solution of the resin prepared by such procedure had an NV value (% by weight of non-volatile components) of 60.5% by weight. The solid resin was prepared by removing the methyl ethyl ketone by vacuum drying. The obtained solids had a residue of 98.8% by weight after heating at 180° C. for 30 minutes.

When the solid resin was examined by gel permeation chromatography, it was found that the resin had a weight average molecular weight $\overline{M}w$ Of 38,000, a number average molecular weight $\overline{M}n$ of 7,000 and a molecular weight distribution $\overline{M}w/\overline{M}n$ of 5.4. The resin had a glass transition temperature of 70° C. as measured by means of an instrument of Model TMS-1 of Perkin-Elmer Co. and a softening point of 120° C. as measured by ring and ball method. The resin prepared by this example is termed as No. 61 sample.

EXAMPLE 11

A magnetic toner was prepared using No. 61 sample as the fixing resin, a magnetite (one available from Toda Kogyo Co. under the trade name of EPT-500) as the magnetic material and carbon black (one available from Mitsubishi Kasei Co. under the trade name of Carbon Black No. 44) as the electroconductive powder. The resin (35 parts by weight), magnetic powder (60 parts by weight) and carbon black (5 parts by weight) were weighed and premixed for 5 minutes under dry condition in a super mixer. The mixture was then plasticized in a kneader (available from Buss Co. under the trade name of Model TR-46) and heated at a temperature from 110° to 120° C. The cooled plasticized mixture was then crushed through a turbo-mill and the pulverized plastic was added with micronized silica (0.5% by weight, one available from Nippon Aerosil Co. under the trade name of Aerosil R 972) and the mixture was mixed thoroughly. The pulverized mixture was caused to fall down through heat-treating oven heated at a temperature from 200° to 300° C. for forming spherules. The toner spherules were then passed through a zigzag classifier to exclude toner particles having a size of less than 3 microns and of higher than 30 microns. The classified toner particles were then added with carbon black (0.1% by weight, No. 44) to prepare a magnetic toner.

When the electric characteristics of the prepared toner were measured by the methods according to this invention, it was found that the electric conductivity was $4\times10^{-}\cdot cm^{-1}$ in an electric field of DC 4,000 V/cm and the dielectric constant was 3.80 at a frequency of 100 KHz. The toner was then evaluated by its image developed by adhering the toner on a developing magnetic roll having 12 magnetic poles and a magnetomotive force of 600 g (available Hitachi Kinzoku Co.). The development was carried out by mounting the toner and the developing machine on the developing unit of a copying machine (available from Xerox Co. under the name of Model 2200), setting the distance from the photosensitive body to the sleeve of the developing machine at 0.4 mm and rotating the developing magnet roll at 1400 rpm. After the development, the toner was electrostatically transferred onto recording paper having an inherent electric volume resistivity of higher than $10^{14}\Omega\cdot cm$ as the transferring sheet to prepare a transferred image of the magnetic toner. The transferred image was also fixed by means of a hot recopying roll heated at a temperature from 160° to 200° C. As a result, the development of the photosensitive body by the magnetic toner and transference of the toner to the transferring sheet were carried out favorably and the fixing of the image by the hot roll was carried out favorably to produce the image having a quality superior to conventional binary toners. In particular, the produced image had high harmony. When a photographic manuscript was recopied, it was found that the recopy had a quality which could not be achieved by conventional binary toners.

EXAMPLE 12

No. 62 sample of styrene/acrylic copolymer was synthesized from 45 molar% of styrene, 30 molar % of n-butyl methacrylate, 10 molar % of isobutyl methacrylate and 15 molar % of acrylic acid similarly to the synthetic example as disclosed hereinbefore.

No. 62 sample had a weight average molecular weight $\overline{M}w$ of 42,000, a number average molecular weight $\overline{M}n$ of 7,000 and a molecular weight distribution $\overline{M}w/\overline{M}n$ of 6.0. It had a glass transition temperature of 72° C. and a softening point of 123° C.

A toner was prepared using No. 62 sample in a fully similar manner to that for Example 1 to be evaluated. The results showed that the toner had an electric conductivity of $2.0\times10^{-13}\ \mho\cdot cm^{-1}$ and a dielectric constant of 4.0 and produced a transferred image of the magnetic toner of high quality and the fixing by means of a hot roll produced no offsetting and the image of high quality.

EXAMPLE 13

No. 63 sample of styrene/acrylic copolymer was synthesized using monomer mixture comprising 45 molar % of styrene, 40 molar % of isobutyl methacrylate, 10 molar % of acrylic acid and 5 molar % of methacrylic acid similarly to the synthetic example as disclosed hereinbefore.

No. 63 sample had a weight average molecular weight $\overline{M}w$ of 48,000, a number average molecular weight $\overline{M}n$ of 8,000 and a molecular weight distribution $\overline{M}w/\overline{M}n$ of 6.0. It had a glass transition temperature of 70° C. and a softening point of 120° C.

A magnetic toner was prepared using No. 63 sample in a fully similar manner to that for Example 11 to be evaluated. The results showed that the toner had an electric conductivity of $5.0\times10^{-13}\cdot cm^{-1}$ and a dielectric constant of 4.15. It produced a transferred image of the toner of high quality and the fixing by means of a hot roll produced no offsetting and the image of high quality.

EXAMPLE 14

No. 64 sample of styrene/acrylic compolymer was synthesized using monomer mixture comprising 35 molar % of styrene, 25 molar % of methyl methacrylate, 20 molar % of n-butyl acrylate and 20 molar % of acrylic acid similarly to the synthetic example as disclosed hereinbefore.

No. 64 sample had a weight average molecular weight $\overline{M}w$ of 49,000, a number average molecular weight $\overline{M}n$ of 8,500 and a molecular weight distribution $\overline{M}w/\overline{M}n$ of 5.76.

It had also a glass transition temperature of 68° C. and a softening point of 118° C.

A magnetic toner was prepared using No. 64 sample in a fully similar manner to that for Example 11 to be evaluated. The results showed that the toner had an electric conductivity of $10^{-13}$ ℧·cm$^{-1}$ and a dielectric constant of 4.25. It produced a transferred image of the toner of high quality and the fixing by means of a hot roll produced the image of high quality without offsetting.

EXAMPLE 15

No. 65 sample of styrene/acrylic copolymer was synthesized using monomer mixture comprising 20 molar % of styrene, 20 molar % of ethyl methacrylate, 55 molar % of n-butyl methacrylate and 5 molar % of methacrylic acid similarly to the synthetic example as disclosed hereinbefore.

No. 65 sample had a weight average molecular weight $\overline{M}w$ of 40,000, a number average molecular weight $\overline{M}n$ of 8,000 and a molecular weight distribution $\overline{M}w/\overline{M}n$ of 5.0. It had also a glass transition temperature of 65° C. and a softening point of 118° C.

A magnetic toner was prepared using No. 65 sample in a fully similar manner to that for Example 11 to be evaluated. The results showed that the toner had an electric conductivity of $8.0\times10^{-13}$ ℧·cm$^{-1}$ and a dielectric constant of 3.95. It produced a transferred image of the toner of high quality and the fixing by means of a hot roll produced an image of high quality free from offsetting.

EXAMPLE 16

No. 66 sample of styrene/acrylic compolymer was synthesized using monomer mixture comprising 60 molar % of styrene. 20 molar % of n-butyl acrylate and 20 molar % of acrylic acid similarly to the synthetic example as disclosed hereinbefore.

No. 66 sample had a weight average molecular weight $\overline{M}w$ of 52,000, a number average molecular weight $\overline{M}n$ of 7,000 and a molecular weight distribution $\overline{M}w/\overline{M}n$ of 7.43. It had also a glass transition temperature of 72° C. and a softening point of 124° C.

A magnetic toner was prepared using No. 66 sample in a fully similar manner to that for Example 11 to be evaluated. The results showed that the toner had an electric conductivity of $10^{-14}$ ℧·cm$^{-1}$ and a dielectric constant of 3.60. It produced a transferred image of the toner of high quality and the fixing by means of a hot roll produced an image of high quality free from offsetting.

EXAMPLE 17

Magnetic toners were prepared using Samples No. 61 through No. 66 of styrene/acrylic copolymers as disclosed in Example Nos. 11 through 16. The toners were prepared similarly to that for Example 11 except that the carbon black was added into the toner spherules in an amount of zero %, 0.05% by weight, 0.5% by weight or 0.6% by weight. When the toners were evaluated similarly to Example 11, the toners containing no carbon black tended to show central fading in solid black areas (i.e., a phenomenon in which the central density of solid black areas is reduced) irrespective of the type of copolymer samples and showed decreased fluidity. On the other hand, the toners containing 0.6% by weight of carbon black showed high fluidity irrespective of the samples, but tended to be fogged. The toners containing carbon black in an amount of 0.05 or 0.5% by weight showed, however, an electric resistivity ranging from $10^{-16}$ to $10^{-9}$ ℧·cm$^{-1}$ and a dielectric constant ranging from 3.0 to 5.0. They could provide transferred images of the magnetic toners of very high quality and the images could be fixed favorably by means of a hot roll.

EXAMPLE 18

Transferred images of the magnetic toners employing Sample Nos. 61 through 66 as disclosed in Examples 11 through 16 were produced employing a recopying machine employing photosensitive zinc oxide (available from Sharp Co. under the trade name of Model SF-730) or a recopying machine employing 2-layered photosensitive body comprising cadmium sulphide and insulating protective layer (available from Canon Co. under the trade name of Model L5) under the same developing conditions as in Example 11. The results showed that the toners produced transferred images of high quality which were fixed favorably by means of a hot roll, irrespective of the type of the toners used and the recopying machines.

Furthermore, examples of magnetic toner for pressure-fixing will be described in detail:

EXAMPLE 19

Twenty-one parts by weight of Hiwax 200P (make of Mitsui Petrochemical Co., Ltd.) of softening point at 128° C., glass transition point at 56.5° C., 7 parts by weight of Ethylene-Vinylacetate Copolymer ACP-400 (make of Allied Chem. Co.), and 70 parts by weight EPT-500 (make of Toda Industrial Co., Ltd.) of magnetic fine particles are mixed, heated and fused at 150° C. in a stainless steel vessel. After cooling, the mixture is crushed and then pulverized in a jet mill. The pulverized toner is blown into a spheroforming furnace at 120°~140° C. through an airjet nozzle. The resulted spheroform toner particles are exempted from those smaller than 5μ and larger than 25μ by a zigzag classifier. Quotients of 0.2%, and 0.4% by weight of thus classified toner are mixed respectively with 0, 0.1%, carbon black #44 of furnace-type of pH at 7.5, being respectively denoted No. 81, No. 82, No. 83 and No. 84. Other quotients are added respectively with 0.1%, 0.2% and 0.4% by weight of carbon black of furnace-type MA-100 (make of Mitsubishi Chem. Co.) of pH at 3.0, being denoted respectively No. 82', No. 83', and No. 84'. These seven samples of toner are determined of their electric characteristics as follows:

TABLE 3

| Toner No. | Electric Characteristics of Magnetic Toner: Dielectric constant | Electric resistivity (Ω . cm) |
|---|---|---|
| 81 | 6.65 | $10^7$ |
| 82 | 3.28 | $2 \times 10^{10}$ |
| 83 | 3.84 | $3 \times 10^9$ |
| 84 | 4.24 | $10^9$ |
| 82' | 3.31 | $5 \times 10^{10}$ |
| 83' | 3.92 | $7 \times 10^9$ |
| 84' | 4.23 | $2 \times 10^9$ |

Each of these seven samples of toner is placed in a duplicator SF-730 (make of Sharp Corp.; magnetic toner-electric field type for recording with ZnO-master paper) to prepare the duplicated toner image. The picture images obtained with Toner Nos. 82, 83 and 84 present very high density and resolving power, while the picture image obtained with Toner No. 1 presents an excellent resolving power and a low density, which is unacceptable. The image transfer efficiency (Density after transfer/Density of master photosensitive material before transfer) is examined and found so bad as less than 50%, i.e. the density of copied image being very low. The image transfer effects of Toners Nos. 82', 83', and 84' are high enough to obtain picture images of high density. However because of double image and uneven density, they are unacceptable.

REFERENTIAL EXAMPLE 4

In the case of preparing toner according to the process of Example 19 except for omitting the spheroforming treatment of toner, the resinous mixture is mixed with 0%, 0.1%, 0.2% and 0.4% of Carbonblack #44 (make of Mitsubishi Chem. Co., Ltd.) of pH at 7.5 to prepare Toner #81", #82", #83", and #84" respectively. When these toners are tested to determine their electric characteristics, the characteristics are found to be similar to those of Toners #81, #82, #83 and #84 respectively. However, when experiments are conducted with the duplicator employed in Example 19, fine picture copies are not produced because Toners #81" and #82" present so poor fluidity that toner becomes coagulated on the developing magnetic roll of the duplicator. In addition, it was learnt that, as duplication was repeated with Toners #83" and #84", the fluidity of toner became lower and the toner tended to coagulate.

EXAMPLE 20

Toners #81~84 and #82'~84' of Example 19 are tested with a duplicator Selex 500 (make of Copyer Co., Ltd.; image-transferring electric field type for the developer of two-component system and employing selenium photoelectric tube) to prepare picture copies. After toner is attached to the developing magnet roll of duplicator and the selenium photosensitive material is developed, the toner image formed thereon is transferred to the copying paper for the Copyer Duplicator. The exposed paper taken out of the duplicator is subjected to pressure-fixation with a fixation roll (make of Hitachi Metals Ltd.; Linear pressure 30 kg/cm). Owing to this fixation treatment, Toners #82, #83 and #84 can provide excellent picture copies, though other toners provide picture copies of lower density or course image, which are unacceptable.

EXAMPLE 21

Magnetic toners are prepared by employing as a pressure-fixation resin one of different resins: Hiwax 200P of Example 19, Hiwax 200P-ethylene-vinyl acetate copolymer ACP-400 at a proportion 7:3 as Example 19, and Hiwax 200P-Versamid 711 (make of Daiichi General K.K.) or a thermoplastic polyamide resin at a rate 10:1.

In this case, 45 parts by weight of Magnetic powder EPT-500 and 55 parts by weight of Fixation resin are mixed to prepare a toner similarly to Example 19, the resulted resinous mixture being denoted Toners #85, #86, and #87 respectively.

The tests for evaluation of toners #85, 86 and 87 are conducted without addition of carbon black. The dielectric constant and electric resistivity and determined as shown in Table 4.

TABLE 4

| Toner No. | Electric Characteristics of Magnetic Toner: Dielectric constant | Electric resistivity (Ω . cm) |
|---|---|---|
| 85 | 5.22 | $10^9$ |
| 86 | 4.00 | $5 \times 10^{10}$ |
| 87 | 4.46 | $1.4 \times 10^9$ |

Subsequently each toner is tested for evaluation similarly to Example 20, employing Selex 500 (a duplicator of Copyer Co., Ltd.) containing selenium photosensitive material. All these toners provide unsatisfactory picture copies, which are unacceptable. Though each toner has a resistivity meeting with the requirement of the present invention, the specific inductive capacity of Toners #85 and #87 comes out of the scope of the present invention. Though the electric characteristics of Toner #86 falls within the scope of the invention, it contains no carbon black, the toner has a poor fluidity and does not provide good picture copies.

Now the present invention is realized with these toners. The amount of Magnetic Powder EPT-500 is increased from 45 parts to 60 parts by weight and the toner after having been prepared is mixed with carbon black of 0.2% by weight on the base of toner, the resulted toners being denoted #85', #86' and #87' respectively. The electric characteristics are found in Table 5.

TABLE 5

| Toner No. | Electric Characteristics of Magnetic Toners: Dielectric constant | Electric resistivity (Ω . cm) |
|---|---|---|
| 85' | 4.20 | $10^{10}$ |
| 86' | 3.95 | $8 \times 10^{10}$ |
| 87' | 4.10 | $3 \times 10^{10}$ |

When these toners are tested for evaluation with Duplicator Selex 500, all of #85, #86 and #87 provide excellent picture copies which are fixed satisfactory by pressure-fixation rolls.

What is claimed is:

1. A magnetic toner composition for the development of electrostatic latent images and for electrostatic transfer-copying comprising a magnetic powder and a resin, wherein said resinous component contains at least one monomer from each of monomer groups (1) to (3), wherein group (1) includes

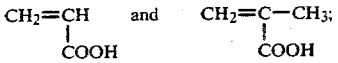

group (2) includes

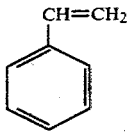

and group (3) includes

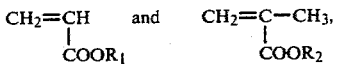

wherein $R_1$ is an alkyl radical containing from 1 to 12 carbon atoms, and $R_2$ is an alkyl radical containing from 2 to 12 carbon atoms, and further wherein said composition has a particulate diameter ranging between 3 and 30 μm, an electric resistivity ranging from between $10^9$ and $10^6$ ohm·cm at 4000 volts/cm DC and a dielectric constant ranging between 2.6 and 5.

2. The magnetic toner of claim 1 wherein said resinous component contains 5 to 20% by mol of the monomer of group (1), 20 to 60% by mol of the monomer of group (2), and 20 to 75% by mol of said monomer of group (3).

3. Magnetic toner as set forth in claim 2 characterized by containing carbon black of 0.05~0.5% by weight on the base of toner amount.

4. The magnetic toner of claim 1 wherein a portion of the monomer of group (2) is replaced by the monomer

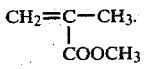

5. The magnetic toner of claim 1 wherein said resinous component has a glass transition temperature higher than 50° C. and a softening point temperature lower than the fixing temperature used when said magnetic toner composition is used to develop electrostatic latent images or for electrostatic transfer-copying.

* * * * *

UNITED STATES PATENT AND TRADEMARK OFFICE

CERTIFICATE OF CORRECTION

PATENT NO. : 4,265,993

DATED : May 5, 1981

INVENTOR(S) : Tsuneaki Kawanishi et al.

It is certified that error appears in the above—identified patent and that said Letters Patent is hereby corrected as shown below:

Claim 1, column 22, line 1, change "$10^{6}$" to --$10^{16}$--.

Signed and Sealed this

*Sixth* Day of *October 1981*

[SEAL]

*Attest:*

GERALD J. MOSSINGHOFF

*Attesting Officer*

*Commissioner of Patents and Trademarks*